US007214092B1

(12) United States Patent
Platt

(10) Patent No.: US 7,214,092 B1
(45) Date of Patent: May 8, 2007

(54) CORD-HOLDING UTENSIL

(76) Inventor: Garwood Isaac Platt, 4907 Old Tree Pl., Sarasota, FL (US) 34233

( * ) Notice: Subject to any disclaimer, the term of this patent is extended or adjusted under 35 U.S.C. 154(b) by 0 days.

(21) Appl. No.: 11/489,297

(22) Filed: Jul. 19, 2006

Related U.S. Application Data

(63) Continuation-in-part of application No. 11/105,764, filed on Apr. 14, 2005.

(51) Int. Cl.
*H01R 13/72* (2006.01)

(52) U.S. Cl. ..... 439/501

(58) Field of Classification Search ..... 439/501, 439/455, 453; 24/129 R, 16 R
See application file for complete search history.

(56) References Cited

U.S. PATENT DOCUMENTS 3,980,806 A * 9/1976 May ..... 174/90
4,979,614 A * 12/1990 Ruhaut ..... 206/702
5,862,030 A * 1/1999 Watkins et al. ..... 361/103
6,301,752 B1 * 10/2001 Koppang ..... 24/129 R
6,425,165 B2 * 7/2002 Koppang ..... 24/129 R

* cited by examiner

*Primary Examiner*—Tulsidas C. Patel
*Assistant Examiner*—PhuongChi Nguyen

(57) ABSTRACT

A utensil for containing electric power cords and other cords for electrical devices is a one-piece tube having a uniform wall thickness. One or both ends of the tube are flared so as to receive a cord which has been folded into a bundle. The central, non-flared portion of the tube firmly grips the bundle. Preferably the utensil is made of plastic and has a polygonal cross-section.

16 Claims, 2 Drawing Sheets

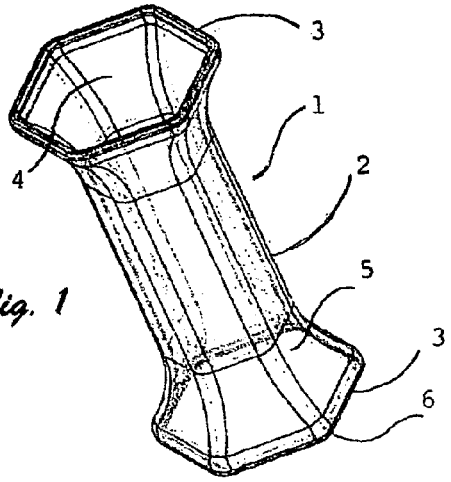
Fig. 1
Fig 2
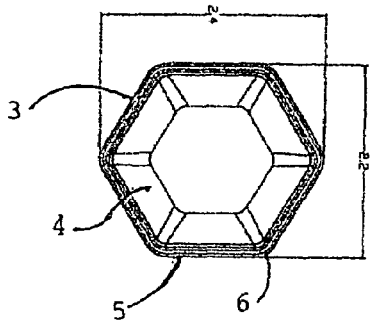
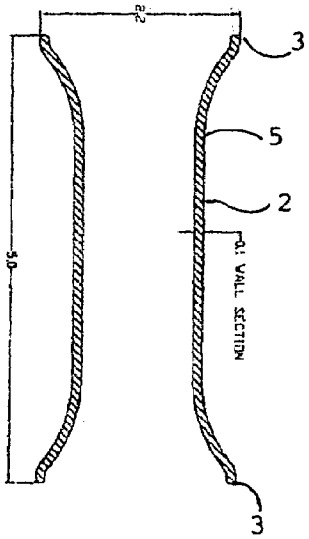
Fig. 3
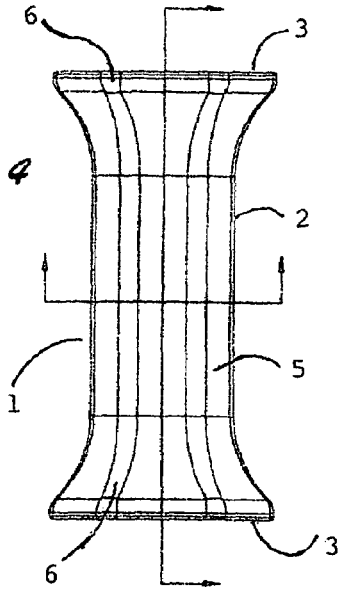
Fig. 4
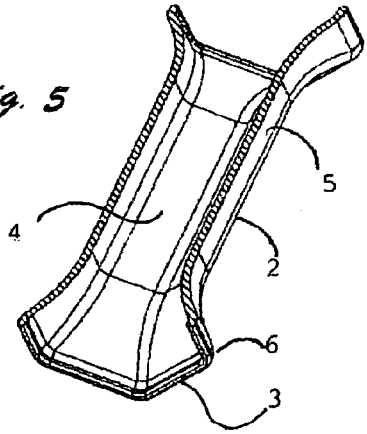
Fig. 5
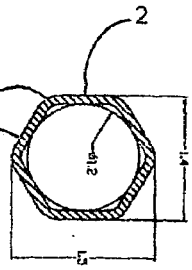
Fig. 6

CORD-HOLDING UTENSIL

CROSS-REFERENCE TO RELATED APPLICATION

This application is a continuation-in-part of copending U.S. application Ser. No. 11/105,764, filed Apr. 14, 2005.

STATEMENT REGARDING FEDERALLY SPONSORED RESEARCH OR DEVELOPMENT

Not applicable.

REFERENCE TO A MICROFICHE APPENDIX

Not applicable.

BACKGROUND

This invention pertains to the field of storing cords for devices requiring electrical current for power, communication, or control. Examples of such devices are household appliances, power tools, computers, telephones and accessories therefor.

The storage of electric cords for household appliances and shop and hobby tools and the like has long been an issue for those who wish an orderly environment. Rubber bands, wire twists and clamps designed for the purpose have not filled this void. They are cumbersome and/or inadequate for the task. There exists a need for a utensil with a simple design that holds the cord neatly and is easy to use.

The following U.S. patents exemplify the prior art: U.S. Pat. Nos. 2,895,003; 3,958,300; 4,138,185; 5,153,969; 6,425,165; 6,698,560; D365,018; D477,772; D479,978.

SUMMARY OF THE INVENTION

The invention is a one-piece tubular utensil for storage of folded-up electric cords of household appliances, shop and hobby tools, and the like. The utensil has a substantially uniform wall thickness. At least one end of the utensil is flared internally and externally for easy insertion of the cord and to provide a smaller, non-flared, generally cylindrical tube in the center that is easily held. The minimum inner diameter of the utensil is sufficiently large to permit the electric cord, folded into several loops so as to form a bundle approximately as long as or longer than the utensil, to be inserted into one end of and passed axially through the utensil. The minimum inner diameter of the utensil is sufficiently small to permit the utensil to firmly grip the bundle while permitting the bundle to be easily removed from the utensil. Each flared portion has an outer surface shaped generally like the bell of a trumpet or a clarinet. The maximum outer diameter of each flared portion is substantially greater than the maximum outer diameter in the central non-flared portion. The utensil preferably has a hexagonal exterior shape to provide stability when resting on a flat counter or table and to provide a better grip when inserting the folded cord bundle.

BRIEF DESCRIPTION OF THE DRAWINGS

FIG. 1 is a perspective view of the utensil.

FIG. 2 is an end view of the utensil shown in FIG. 1.

FIG. 3 is a front view of a section taken along the longitudinal axis, and across the flats, of the utensil shown in FIG. 1.

FIG. 4 is a front view of the utensil shown in FIG. 1.

FIG. 5 is a cutaway perspective view of the utensil shown in FIG. 1.

FIG. 6 is an end view of a section taken perpendicular to the longitudinal axis of the utensil shown in FIG. 1, equidistant from the ends of the utensil.

DESCRIPTION OF THE INVENTION

Figure 7:
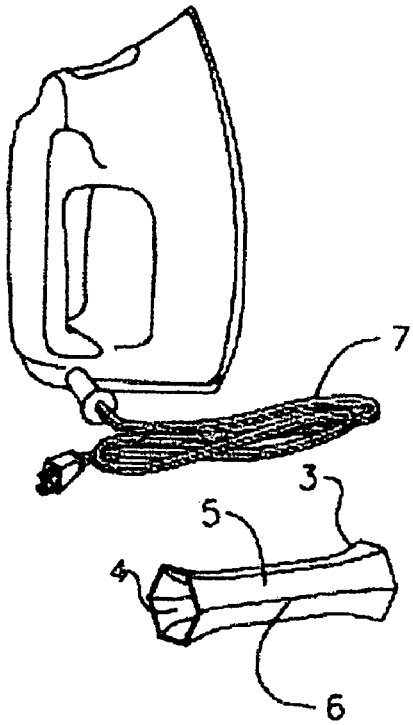
FIG. 7 is a perspective view of an appliance (electric iron) cord bundled for insertion into a utensil.
Figure 8:
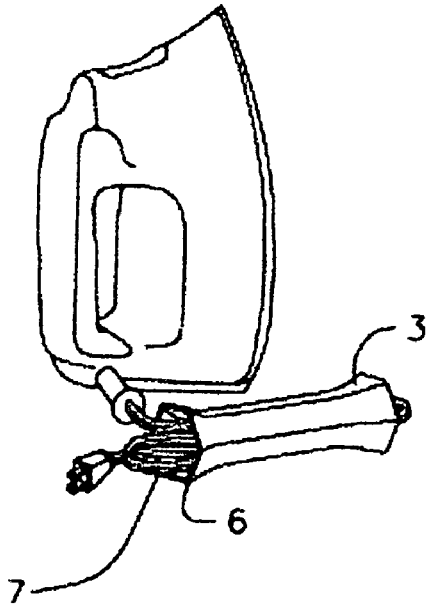
FIG. 8 is a perspective view similar to FIG. 7, but showing the bundle inserted in the utensil, ready for storage.

As shown in FIGS. 1–8, the dimensions of which are not necessarily optimal, the invention is a one-piece utensil 1 consisting of an elongated tube 2 for containing electric cords of appliances and small electric tools. It is made of a lightweight, durable, inexpensive material of a uniform thickness sufficient to provide the required strength and rigidity. If used for appliances such as irons, the material should be heat resistant. Ends 3 are flared internally and externally, mimicking the shape of the cord bundle they hold. This shape permits the flare to be designed sufficiently large to optimally perform the insertion of the folded electric cord bundle 7 without being constrained by the external diameter of the tube from which it is made. The shape also permits the external diameter of the tube 2 to be small enough to be grasped by women, who are likely to be the majority of users. If the cord is 12 feet long, for example, the maximum diameter of the utensil would be larger, but the non-flared portion could still be grasped by small hands. The cross-section of the interior surface 4 is either polygonal or circular. The utensil shown has a hexagonal cross-section, with six slightly rounded corners 6. To increase its holding capability, the utensil 1 may be slightly flexible or pliable and the interior surface 4 may be ridged or undulating or have a coarse texture. The preferred shape of exterior surface 5 is polygonal to prevent the utensil 1 from rolling and to increase the user's grip. An appliance cord is folded on itself with the plug on the end of the bundle 7 of folded cord closest to the appliance. The distant end of bundle 7 is inserted into the utensil 1, which can firmly grip the cord bundle 7 because it does not have to be large enough to accommodate the plug. This is shown in FIGS. 7 and 8. Thus, the cord is held neatly until the appliance or tool is needed, at which time it is easily removed from the utensil 1 for use of the appliance.

The flared portions at the ends of the utensil have a number of advantages. First, the large opening facilitates the insertion of the end of the folded cord bundle as the bundle first enters the tube. It vides a better target for the user and eliminates or reduces the need to squeeze the bundle merely to begin its entry. Second, the flared portion guides and compresses the loosely folded bundle as it progresses lengthwise within the utensil, until the end of the bundle enters and passes through the non-flared portion and then protrudes from the other end of the utensil, so that the non-flared portion of the utensil firmly grips the bundle. Third, an externally and internally flared tube of substantially uniform wall thickness saves plastic material by providing a flared inner surface without adding excess plastic merely to grip the cord bundle. In contrast, Koppang U.S. Pat. No. 6,425,165 teaches a cord holder of non-uniform wall thickness, which has excess plastic on its inner surface for this purpose. Fourth, a flared utensil resting on a flat surface such as a table will have a space beneath its non-flared portion, allowing the user's thumb and fingers to easily encircle that portion. In contrast, a cylindrical utensil would rest flat against the surface and would not provide such a space. Fifth, the wall of substantially uniform thickness is economical because it allows the utensil to be produced from extruded, edge-to-edge sealed, or similarly produced plastic tubing, as opposed to molding and other more expensive processes. Accordingly, the term "substantially uniform wall thickness" is used herein to include any such material, irrespective of its manufacturing tolerances and irrespective of any thickness reductions resulting from the flaring. In this context, "substantially" means "approximately". Of course, "substantially uniform thickness" excludes differences in thickness taught by the Koppang patent, in which the ratio of thickest wall thickness/thinnest wall thickness is 3 or more. Sixth, when the user grips the tube for insertion of the bundle, the outer surface of the flare serves as a shoulder that abuts the side surface of the user's hand (thumb, forefinger, knuckle and connecting tissue) so that he/she does not need to grip the tube as tightly in order to counter the force of insertion of the bundle and keep the utensil from being carried along with it. In this respect the function of the flare is similar to that of a guard on the hilt of a hunting knife whose point is being urged into something. Seventh, the flared ends provide an ergonomic shape that is inviting to pick up and comfortable to hold. Eighth, the flared ends enable the utensil to have a sufficient length for handling and controlling the bundled cord, while increasing the radius of curvature allowed for the protruding loop or loops.

Preferably both ends of the utensil are flared, as shown and described. This enables the cord bundle to be inserted into either end, provides increased stability and resistance to rolling when the utensil is resting on a flat surface, and follows more closely the natural contours of the cord bundle. However, it may be desirable for only one end to be flared. This may permit the unflared end to more positively grip the portion of the bundle protruding from it and resist its withdrawal and may permit more efficient nesting of multiple utensils. An example of the latter might be several empty utensils of different sizes, coaxially nested one within the other, like Russian dolls, in a package suitable for shipment or retail sale. It is also possible to flare each end differently from the other so that they have different degrees of flare, in which case the end with the greater flare will be the entrance end.

It is not necessary that the non-flared portion of the utensil be cylindrical. For example, it could be moderately bulbous, like the central portion of a Coca-Colas bottle, in order to better fit the user's hand.

While the polygonal cross-section configuration is preferred, the utensil may alternatively have a circular cross-section. In this configuration, the cross-section of the utensil will have, for example, the cross-section of FIG. 3 for all 360° of rotation of the section plane on the longitudinal axis.

Polymeric plastic is the preferred material for the utensil because it is economical, durable, easy to clean and is sufficiently slick to permit easy access and removal of the cord to and from the utensil. Examples of the particular plastic materials are polypropylene, polyethylene, polyvinyl chloride and polyurethane.

The embodiment of the utensil shown and described has the following dimensions:

Wall thickness 0.1 in.
Length 5.0 in.
Length of non-flared portion 3.0 in.
Length of each flared portion 1.0 in.
Inner diameter in non-flared portion at flats 1.2 in.
Inner diameter in non-flared portion at corners 1.3 in.
Outer diameter in non-flared portion at flats 1.4 in.
Outer diameter in non-flared portion at corners 1.5 in.
Inner diameter at end at flats 2.0 in.
Inner diameter at end at corners 2.2 in.
Outer diameter at end at flats 2.2 in.
Outer diameter at end at corners 2.4 in.
Flare, i.d., measured at flats 0.8 in.
Flare, o.d., measured at flats 0.8 in.
Flare, i.d., measured at corners 0.9 in.
Flare, o.d., measured at corners 0.9 in.
Ratio of flare/wall thickness, measured at flats 8
Ratio of flare/wall thickness, measured at corners 9

"Flare" refers to the magnitude of the difference between the diameter at the end and the diameter at the central, non-flared portion, as measured between points on the same surface which are in the same plane as the tube's longitudinal axis. That is, $F=D_e-D_c$ where F is the magnitude of "flare", $D_e$ is the diameter at the end of the tube, and $D_c$ is the diameter at the central portion of the tube.

While the invention has been described with reference to an electrical appliance to which a power cord is permanently connected, it will be understood that it may also be used with any cord for any device requiring electrical current for power, communication, or control. Examples of such devices are household appliances, power tools, computers, telephones and accessories therefor. The utensil may also be used for a removable cord. In addition, it may be used to store a portion of a cord which has been folded into a bundle for the purpose of effectively "shortening" the cord when it is plugged in, in order to reduce clutter or promote safety, as might be desired for a table lamp. The diameter and flexibility of the cord will influence the diameter of the utensil. For example, a utensil for an electric iron cord will have a larger diameter than a utensil for a computer keyboard cord, which in turn will have a larger diameter than a utensil for a telephone cord. Also, longer cords will require a larger utensil diameter.

It will be understood that, while presently preferred embodiments of the invention have been illustrated and described, the invention is not limited thereto, but may be otherwise variously embodied within the scope of the following claims. It will also be understood that the method claims are not intended to be limited to the particular sequence in which the method steps are listed therein, unless specifically stated therein or required by description set forth in the steps.

The invention claimed is:

1. A one-piece utensil for containing a cord of or for an electrical device, which utensil comprises an elongated tube having:

(a) a longitudinal axis, an inner surface, an outer surface, and two opposite, open ends;

(b) a substantially uniform wall thickness between the opposite ends;

(c) a flared portion at an end of the tube; which flared portion (i) is bell-shaped, (ii) has bell-shaped inner and outer surfaces, (iii) is sufficiently large at its open end to provide a target for and to receive the electric cord when the cord is loosely folded into several loops forming a bundle approximately as long as, or longer than, the utensil, and (iv) is shaped and sized so as to guide and compress such a bundle being moved along the longitudinal axis; and (d) a central portion located between the ends and having a minimum inner diameter which (i) is sufficiently large to permit such a bundle to pass axially through the utensil, (ii) is sufficiently small to permit the utensil to positively and firmly grip the bundle while permitting it to be easily removed from the utensil, and (iii) has a maximum outer diameter which is substantially smaller than the maximum outer diameter of the flared portion.

2. A utensil according to claim 1 wherein the interior and exterior surfaces of the tube have a hexagonal cross-section.

3. A utensil according to claim 1 which is made of substantially rigid polypropylene, polyethylene, polyvinyl chloride, or polyurethane.

4. A utensil according to claim 1 wherein the thickness of said wall is within the range of approximately 0.05 in. to approximately 0.2 in.

5. A utensil according to claim 1 wherein the thickness of said wall is approximately 0.1 in.

6. A utensil according to claim 1 wherein the minimum outer diameter is approximately 1.4 in. and the maximum outer diameter is approximately 2.4 in.

7. A utensil according to claim 1 wherein the flared portion has an outer surface shaped generally like the bell of a clarinet.

8. A utensil according to claim 1 wherein the central portion of the utensil is generally cylindrical.

9. A method of containing a cord of or for an electrical device, which method comprises the steps of:

(a) providing a utensil according to claim 1;

(b) folding the cord into sufficient loops to form a bundle approximately as long as, or longer than, the utensil;

(c) inserting an end of the bundle of folded cord loops into the flared end of the utensil;

(d) forcing the bundle further into the utensil, so that the flared portion guides and compresses the bundle, until that end of the bundle protrudes from the other end of the utensil and the central portion firmly grips the bundle.

10. A utensil according to claim 1 wherein the flare, as measured on the exterior surface between points in the same plane as the longitudinal axis, is substantially greater than the wall thickness.

11. A utensil according to claim 1 wherein both ends of the tube are flared.

12. A utensil according to claim 11 wherein the flare of each flared portion, as measured on the exterior surface between points in the same plane as the longitudinal axis, is several times greater than the wall thickness.

13. A utensil according to claim 11 wherein the flare of each flared portion, as measured on the exterior surface between points in the same plane as the longitudinal axis, is approximately 8 times greater than the wall thickness.

14. A utensil according to claim 11 wherein the flare of each flared portion, as measured on the exterior surface between points in the same plane as the longitudinal axis, has a magnitude of approximately 0.8 inches.

15. A utensil according to claim 11 wherein, when the utensil is resting on a flat surface, the magnitude of the flare of each of the flared portions is sufficient to space the central portion from the flat surface by a distance which facilitates the user's grasping of the central portion.

16. A utensil according to claim 11 wherein, when the user grips the tube for insertion of the bundle, the outer surface of one of the flared portions serves as a shoulder that abuts the user's thumb and forefinger, thereby enabling that side of the user's gripping hand to counter the force exerted on the utensil by the bundle.

* * * * *